United States Patent [19]

Farnsworth

[11] Patent Number: 4,584,090

[45] Date of Patent: Apr. 22, 1986

[54] METHOD AND APPARATUS FOR CATALYTICALLY CONVERTING FRACTIONS OF CRUDE OIL BOILING ABOVE GASOLINE

[76] Inventor: Carl D. Farnsworth, 2401 Sedley Rd., Charlotte, N.C. 28211

[21] Appl. No.: 648,090

[22] Filed: Sep. 7, 1984

[51] Int. Cl.[4] ..... C10G 51/06; C10G 55/08

[52] U.S. Cl. ..... 208/80; 208/86; 208/89; 208/92; 208/155; 208/164; 502/43

[58] Field of Search ..... 208/78, 80, 89, 111, 208/164, 155, 86, 92, 93, 211, 212, 95; 502/43

[56] References Cited

U.S. PATENT DOCUMENTS

| | | | |
|---|---|---|---|
| 2,684,931 | 7/1954 | Berg | 196/52 |
| 2,702,267 | 2/1955 | Keith | 198/52 |
| 2,906,703 | 9/1959 | Dalla Valla | 208/149 |
| 3,188,185 | 6/1965 | Slyngstad et al. | 23/288 |
| 3,287,254 | 11/1966 | Paterson | 208/80 |
| 3,293,169 | 12/1966 | Kozlowski et al. | 208/80 |
| 3,379,639 | 4/1968 | Vallino, Jr. | 208/80 |
| 3,406,112 | 10/1968 | Bowles | 208/153 |
| 3,785,962 | 1/1974 | Conner et al. | 208/164 |
| 3,856,659 | 12/1974 | Owen | 208/80 |
| 3,886,060 | 5/1975 | Owen | 208/120 |
| 3,898,050 | 8/1975 | Strothers | 23/288 |
| 3,926,778 | 12/1975 | Owen et al. | 208/78 |
| 3,928,175 | 12/1975 | Owen | 208/80 |
| 4,010,003 | 3/1977 | Pulak | 23/288 |
| 4,035,284 | 7/1977 | Gross et al. | 208/120 |
| 4,116,814 | 9/1978 | Zahner | 208/78 |
| 4,219,407 | 8/1980 | Haddad | 208/151 |
| 4,310,489 | 1/1982 | Fahrig et al. | 422/110 |
| 4,313,910 | 2/1982 | Dries et al. | 422/147 |
| 4,316,794 | 2/1982 | Schoennagel | 208/111 |
| 4,387,043 | 6/1983 | Vickers et al. | 252/417 |

*Primary Examiner*—Andrew H. Metz
*Assistant Examiner*—Arthur McFarlane
*Attorney, Agent, or Firm*—Richard C. Willson, Jr.; Michael D. McIntosh; David E. Boone

[57] ABSTRACT

A method for catalytically cracking different fractions of crude oil with a zeolite containing catalyst in separate riser regeneration zone followed by sequential regeneration of catalyst particles in separate riser regeneration zones is described wherein the hydrocarbon vapor-catalyst suspension of hydrocarbon conversion is discharged downwardly from a half circle centrifugal separation conduit comprising the riser upper discharge section, second stage riser regeneration of catalyst is discharged downwardly from a half circle centrifugal separation section into the top of a high temperature catalyst recovery zone provided with cyclone separation zones external thereto. The first stage upflow riser regeneration zone is effected with oxygen lean gas and steam in an amount equal to, more or less, than the oxygen containing gas whereby the regeneration temperature is restricted from exceeding a desired upper temperature limit with or without promoting the water gas shift reaction.

20 Claims, 1 Drawing Figure

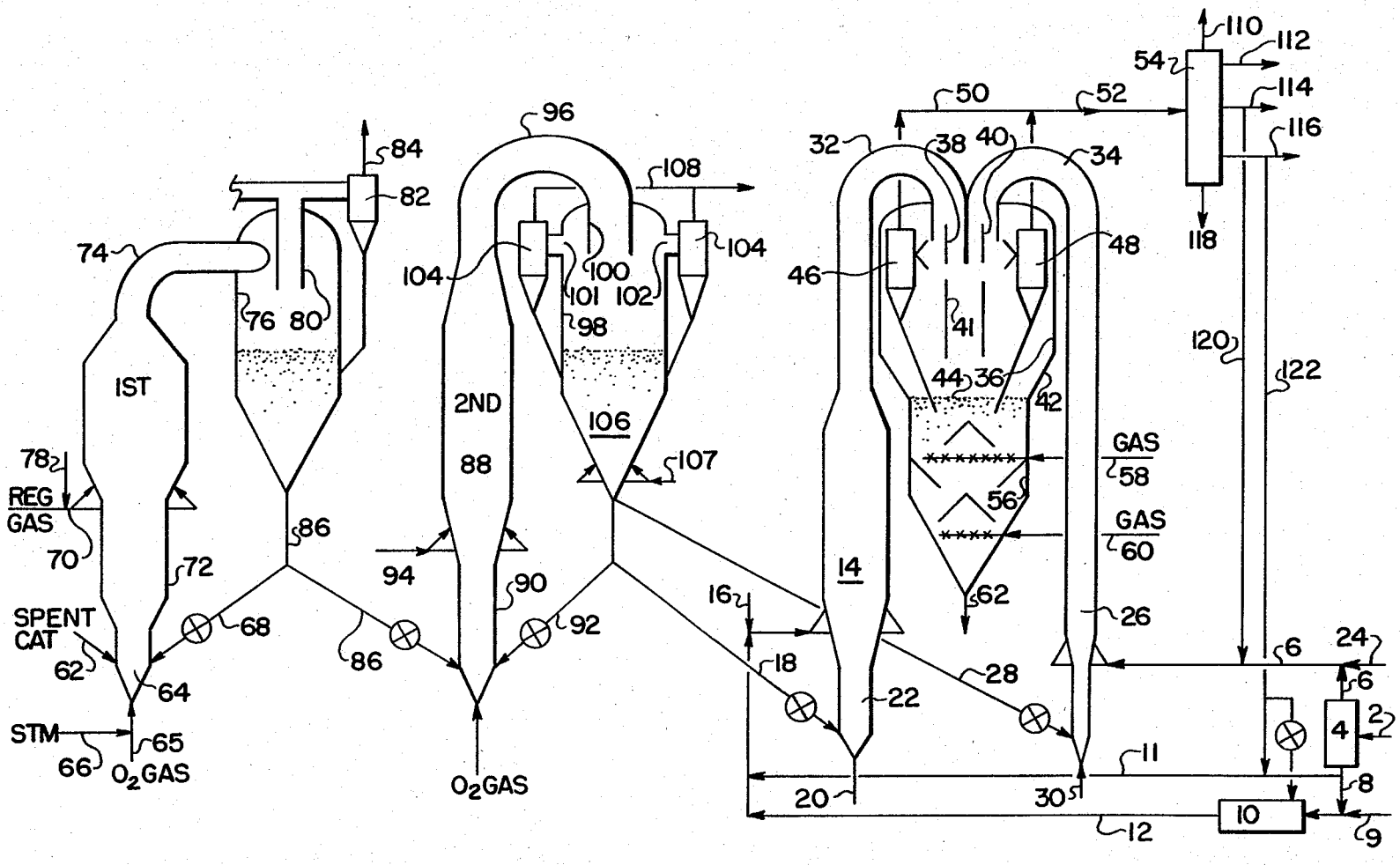
GAS
58
GAS
60
2ND
88
1ST
O2GAS
O2GAS
REG
GAS
SPENT
CAT
STM

METHOD AND APPARATUS FOR CATALYTICALLY CONVERTING FRACTIONS OF CRUDE OIL BOILING ABOVE GASOLINE

This invention relates to an improved method and arrangement of apparatus for catalytically converting fractions of crude oil to produce liquid fuel products comprising gasoline, light and heavier liquid fuel oil products. It relates in one embodiment to a dual riser catalytic cracking hydrocarbon conversion operations for separately cracking selected different fractions of crude oil in combination with a novel arrangement and sequence for the regeneration of catalyst particles used in the hydrocarbon conversion operations to achieve more selective catalyst regeneration results.

BACKGROUND OF THE INVENTION

The development of fluid catalyst cracking FCC systems has been an on-going challenge since the early '40's. This challenge has been stimulated considerably by the development of improved catalysts and particularly the crystalline zeolite (aluminosilicate) containing catalyst of acceptable cracking activity.

Berg U.S. Pat. No. 2,684,931 identifies early fluidized solids catalytic cracking and regeneration of catalyst solids in dense fluid bed operations. The catalyst solids are conveyed upwardly in riser conduits with lift gas which discharge into the bottom of the dense fluid catalyst beds used to effect hydrocarbon conversion and regeneration of catalyst particles. The lift gas to the regenerator may be flue gas with the lift gas into the cracking zone selected from a number of different materials such as hydrogen, methane and unsaturated or saturated normally gaseous products of cracking.

Keith U.S. Pat. No. 2,702,267 discloses a hydrocarbon conversion process which includes stripping of the fouled catalyst with regeneration gases comprising hydrogen. This reference relies upon the use of a steam-high purity oxygen mixture to achieve the known water gas shift reactions to effect a partial removal of deposits of catalytic cracking.

Owen U.S. Pat. No. 3,886,060 discloses an arrangement of apparatus for effecting separate two stage riser hydrocarbon conversion in combination with two stage regeneration of the catalyst employing a first upflowing catalyst regeneration operation followed by a downflowing catalyst second stage of regeneration.

Haddad et al U.S. Pat. No. 4,219,407 discloses discharging a catalyst suspension from a riser zone outwardly and downwardly through channel means open in the bottom thereof. The downwardly discharged catalyst particles are directed into an elongated confined restricting zone provided with sloping baffle means and stripping steam inlet means in a bottom portion thereof.

Pulak U.S. Pat. No. 4,010,003 discloses an apparatus arrangement comprising a catalyst upflow regeneration zone of larger diameter dimensions in a lower portion than the upper portion of restricted diameter used to convey suspended catalyst of regeneration horizontally into an adjacent flue gas-catalyst particle relatively large separation zone provided with interval cyclone separation means. The suspension so horizontally conveyed is directed downwardly by baffle means within the separation zone.

Crude oils from which desired liquid fuels are obtained contain a highly diverse mixture of hydrocarbons, sulfur, nitrogen compounds and metal contaminants of nickel, vanadium, iron, copper, arsenic and sodium. The hydrocarbons vary widely in molecular weight and structure with the hydrogen lean complicated molecular structures concentrated in the higher boiling portion of the crude oil boiling above vacuum gas oils. For example, crude oils are known in which 30 to 60%, or more, of the total volume of oil is composed of compounds boiling at a temperature above 650° F. and in which from about 10% to about 30%, or more, of the total volume comprise molecular structure which boil above about 1000° F. or 1025° F.

Residual portions of crude oil comprising gas oils and high boiling molecular structures boiling above 650° F. are unsuitable for inclusion in gasoline and desired light cycle oil products. Therefore, the petroleum refining industry is required to develop economic processes for converting the higher boiling hydrocarbon structure to form lower boiling desired liquid fuel products of gasoline and light cycle oils which do not boil above a desired product range. The fluid catalytic cracking process (FCC) is the most widely used process to accomplish this purpose.

Crude oils and fractions thereof are normally subjected to pretreatment operations which remove arsenic and sodium to some considerable extent. Also, the heavy metals of nickel, vanadium, iron and copper, which tend to concentrate in the higher boiling portion of the crude oil boiling above about 1025° F. or 1050° F., may be removed partially by one or more methods comprising hydrogenation, delayed coking, solvent extraction and other operations known in the industry. For example, when hydrodesulfurizing the heavier high boiling portion of the crude oil, substantial metal contaminants are removed along with sulfur and nitrogen.

When subjecting the higher boiling portions of crude oil such as a vacuum resid without pretreatment to fluid catalytic cracking, the metal contaminants deposit on the catalyst, thereby reducing it's cracking activity. Other materials such as coke precursors providing Conradson carbon deposits including asphaltenes and higher molecular weight polycyclic structures of 2 to 4, or more, ring compounds break down, leaving deposit on the catalyst, thereby deactivating the catalyst. It has been observed that the heavy metals in the feed transfer almost quantitatively from the feed stock to the catalyst and are not economically removed therefrom, requiring replacement of metals contaminated catalyst with fresh catalyst.

It has been recognized by many in the industry that there is a substantial imbalance in the carbon/hydrogen rates of the residuum portion of crude oil and such imbalance provides a complex set of technical and economic alternatives to be dealt with. This problem is aggravated substantially by changes in price available to the refiner for the asphalt content of crude oil when it becomes more valuable than refined liquid product such as gasoline, light and heavy liquid fuel oils.

The heavier crude oils are characterized as having a higher concentration of residuum. This residuum portion boiling above vacuum gas oils has a high concentration of nitrogen, sulfur, asphaltenes and higher boiling polycyclic ring compounds including porphyrins, as well as metal contaminants herein identified. A fundamental result of these increased heavy oil residuum components is a lower hydrogen to carbon ratio. However, product demand varies with the seasons and has been directed to providing more saturated middle distillate light oil products including materials readily converted to jet fuels during certain seasons which necessarily requires a substantially higher hydrogen to carbon ratio than is generally available from all residual oil fractions.

In a recent paper entitled "Hydrogen Utilization In Residuum Conversion", presented by Rosenthal et al, Chevron Research Company, at the 48th Midyear Refining Meeting, Session on Heavy Oils Processing, Tuesday, May 10, 1984, Los Angeles, Calif., reference is made to information developed by B. E. Stangeland of Chevron Research, concerned with the variation of hydrogen to carbon ratio with increasing molecular weight of crude oils and hydrocarbon fractions thereof. A chart developed by Stangeland shows the extent to which the carbon number must be reduced and sufficient hydrogen added to generate a desired light feed stock. This illustrates the importance of hydrogen addition when producing mid-distillates gas oils and lube oils. Such materials are characterized by quite low aromatic levels and desirably of high hydrogen content.

The impact of using four different primary residuum processing steps on the hydrogen content of the raw liquid products obtained is graphically shown in FIG. 2 of the paper. The four processing steps chosen to demonstrate by comparison the concept were delayed coking and fluid coking (thermal processes) and FCC (fluid catalytic cracking) and residuum hydrodesulfurization as examples of catalytic processes. FIG. 2 clearly shows that the thermal processes produce lighter oils. However, these lighter oils are also much lower in hydrogen content and less than that desired in a middle distillate product fraction. Fluid coking offers the production of more liquid; but the liquid is of a lower hydrogen content than that obtained from delayed coking.

A fluid catalytic cracking operation is identified as producing high conversions, but yields products with relatively low hydrogen content. A residuum desulfurization (RDS), on the other hand, produces relatively light products that have a relatively high hydrogen content when obtained at lower residuum conversion levels.

The information above identified in the referenced paper shows indirectly and directly that a refiner has the choice of adding hydrogen to the product obtained at high yields in one or a combination of heavy oil pretreating and hydrofining steps bordering a primary conversion step of catalytic cracking.

The combination operation of the present invention and method of utilization is concerned in substantial manner with improving the hydrogen to carbon ratio of products of fluid catalytic cracking.

SUMMARY OF THE INVENTION

This invention is directed to the method and arrangement of apparatus for effecting the catalytic conversion of hydrocarbons boiling above 400° F. or 600° F. to produce liquid fuel products boiling below about 650° F. or 600° F. and comprising gasoline, light cycle oils and gaseous components convertible to liquid fuel products. In another particular aspect, the present invention is directed to providing a relatively low apparatus profile arrangement and a selected method of utilization for upgrading residual portions of crude oils boiling above 400° F. and more usually above 500° or 650° F. Thus, it is contemplated processing oil feeds comprising an end boiling point above 1025° F. comprising metal contaminants and contributing Conradson carbon deposits. On the other hand, it is also contemplated processing a residual portion of crude oil provided with an end boiling point less than 1200° F. and more usually not above about 1100° F. In yet a further aspect, the catalytic cracking operation of this invention is directed to a split feed riser cracking operation in which a light oil fraction is subjected to catalytic cracking in at least one riser zone under selected more optimum catalyst to oil ratio temperature and contact time conversion conditions. A higher boiling oil fraction of the crude oil is catalytically cracked in a separate riser zone under particularly selected operating conditions of time, temperature and catalyst to oil ratio more particularly optimizing conversion of the higher boiling fraction to selected and desired lower boiling liquid products. Thus, in one embodiment of this invention, a fraction with an end boiling point in the range of 650° or 800° F. comprising a middle distillate with or without light vacuum gas oil is subjected to catalytic cracking in one riser zone with a higher boiling gas oil containing fraction being catalytically converted in a separate second riser conversion zone with or without the presence of vacuum resid, a product of coking or a solvent extracted fraction thereof. It is also contemplated in another embodiment of converting a light vacuum gas oil and a lower boiling fraction boiling above straight run gasoline charged together or separately to a first riser catalytic cracking zone comprising catalyst suspended in $H_2$ containing gas.

A higher boiling vacuum gas oil alone or in combination with vacuum resid is charged together or separately to a second separate riser cracking zone for catalytic upgrading in the presence of a hydrogen containing fluidizing gas and diluent lift gas.

In any of the oil feed processing combinations herein identified, it is further contemplated prehydrogenating either one or both of the feeds charged to the separate riser catalytic cracking zones. On the other hand, only the higher boiling residuum containing feed portion to be catalytically cracked is prehydrogenated to remove some sulfur and nitrogen and some metal contaminants from the feed in addition to effecting hydrogenation of multi-cyclic ring compounds in the heavy feed prior to effecting catalytic cracking thereof. It is particularly contemplated charging an atomizing diluent gasiform material with the oil feed to also reduce it's partial pressure when charged to a riser reactor. Diluents such as steam, hydrogen, $CO_2$ mixtures, dry gas, wet gas, low boiling materials known as carbon-hydrogen fragment contributors such as a lower alcohols of methanol, ethanol or prepanol, light olefins and hydrogen transfer materials are premixed particularly with the higher boiling feed portions to be catalytically cracked.

Such diluents also desirably reduce the oil feed partial pressure in the catalytic conversion section of a riser.

The catalytic conversion of the different oil feeds herein identified necessarily require the use of a highly versatile operation responsive to seasonal changes and products desired. Also, the arrangement of apparatus employed must provide versatility. That is, the variations in coke (carbonaceous material) deposition will vary considerably depending on the combination of oil feeds processed, the heat balance required by a given operation, protection of the catalyst employed against excessive hydrothermal deactivation and providing sufficient catalyst at a desired elevated temperature needed to vaporize and convert the highest boiling components in the feed charged to a given riser zone.

The more refractory components of the oil feed require selective conditions to accomplish conversion thereof to gasoline and light cycle oil liquid products.

The catalytic conversion of residual portions of crude oils is known to include a combination of reactions comprising dehydrogenation, hydrogenation, hydrogen transfer, cyclization, isomerization and the cracking of high molecular weight structures comprising asphaltenes and other orders of cyclic compounds in the oil feed. Thus, it is important to use catalysts which promote the reactions desired with a high degree of efficiency and rate providing a desired product.

Many different catalyst compositions are suggested in the prior art for achieving a selective cracking of a given oil feed. That is, crystalline zeolites (aluminosilicates) of many different compositions and pore structures are available which are used alone or in combination with one another and dispersed in the range of 10 to 50 or more wt. % in a matrix composition normally siliceous in combination with one or more components providing cracking activity or no cracking activity. Faujasite type crystalline zeolites of the X and Y type catalytically activated by exchange techniques to provide hydrogen or rare earth exchanged forms thereof and combinations thereof appear to be the most popular zeolite containing catalyst used in catalytic cracking of oil feeds. Provisions are made in the prior art to use from 10 to 90 wt. % of the zeolite in a suitable matrix material. Also, provisions are made in the prior art to passivate known metal contaminants of nickel and vanadium deposited on the cracking catalyst by the oil feed during catalytic cracking, thereof. The metal contaminants are identified in the prior art as nickel, vanadium, iron, copper, arsenic and sodium as the most prevalent contaminants. It is recognized by the prior art that the cracking catalyst employed will become deactivated by the deposition of these metal contaminants thereby providing a catalyst composition below a desired equilibrium catalyst activity known as the MAT activity. To rectify this condition with and without contaminant metal passivation, it is necessary to replace used or spent catalyst with fresher catalyst intermittently or continuously. Generally, catalyst replacement, depending on the feed being processed, will be within the range of 0.5 to 3 lbs of catalyst per barrel of charged oil feed. It is desirable to maintain the catalyst replacement rate as low as possible, however, for economic reasons.

The versatile combination catalytic cracking-regeneration operation of this invention is adaptable, therefore, to using any satisfactory crystalline zeolite (aluminosilicate) catalyst and combinations, thereof, of predetermined and selected cracking activity. Furthermore, the method and arrangement of apparatus of this invention permits achieving a desired and carefully monitored heat balanced operation for a redidual oil feed composition being processed. That is, the combination of regeneration operations provided may be restricted from exceeding a temperature limit in the range of 1500° to 1600° F. in both stages of regeneration or just the first stage with the second stage of regeneration being permitted to exceed 1600° F. in some special operations to achieve a desired residual coke reduction on the regenerated catalyst, The heat balance of the regeneration operation of this invention is controlled in response to the oil feeds being catalytically cracked, the amount of carbonaceous deposit and, thus, in substantial measure by the oxygen concentration provided in each step of the regeneration operation. This may or may not be implemented by providing steam admixed with a selected oxygen rich gas, a CO combustion promoting additive admixed with the catalyst and/or combinations thereof charged to the separate stages of catalyst regeneration discussed herein. Some liquid water may also be added as required directly to the first stage of catalyst regeneration to restrict the temperature thereof below that causing substantial hydrothermal catalyst damage. The sequence of regeneration operations and apparatus arrangements are also adaptable to suitable prior art temperature restrictions in the range of 1200° to 1400° F. without the need for providing expensive catalyst cooling by indirect heat exchange means in the regeneration zone or between regeneration zones. The addition of water and/or steam with oxygen restriction to the first stage of catalyst regeneration will produce a flue gas comprising CO, $CO_2$, and $H_2$ absent a combustion supporting amount of oxygen. Thus, the water gas shift reaction is promoted substantially by providing a steam to oxygen ratio greater than one and more usually within the range of about 2 to 4. Thus, some partial combustion of carbonaceous material and conversion, thereof, with oxygen lean gas and $CO_2$ in conjunction with promoting the important water gas shift reaction between $CO+H_2O+CO_2+H_2$ is particularly promoted in a first stage of catalyst regeneration. An operating temperature environment is achieved by mixing high temperature regenerated or partially regenerated catalyst and suspending the mixture in a preheated mixture of steam and oxygen lean gas at an elevated temperature up to about 1000° F. An initially formed suspension of catalyst particles and reactant gas, above discussed, is charged into a bottom portion of a rising fluid phase or mass of catalyst particles being partially regenerated as herein provided. The fluid phase of catalyst particles is maintained in a particle concentration in the range of 10 to 35 lbs/cu.ft. The catalyst particles, thus partially regenerated are thereafter contacted with a gaseous mixture which removes products of the water gas shift reaction comprising formed hydrogen from the catalyst before passage of the catalyst to a second stage of regeneration, wherein the catalyst is contacted with oxygen rich gas in the absence of steam to achieve desired further removal of residual coke deposits. The removal of any entrained hydrogen from partially regenerated catalyst is preferably accomplished with gaseous material which maintain the temperature of the partially regenerated catalyst at least 1400° F. A gaseous material suitable for this purpose includes an oxygen lean gas of little or no steam content and preferably a high temperature $CO_2$ flue gas product of regeneration comprising little, if any, oxygen.

The catalyst thus partially regenerated as above discussed, is withdrawn at an elevated temperature in the range of 1400° to 1600° F. and preferably at a temperature of 1450° or 1500° F. for cascade to a second stage of catalyst regeneration without encountering any significant temperature reduction. The second stage of catalyst regeneration is preferably accomplished with oxygen containing gas in the absence of steam to achieve combustion removal of carbon deposits on the partially regenerated catalyst to a residual coke level below 0.25 wt. % and preferably to about 0.1 wt. %. The second stage of regeneration comprises a riser regeneration zone. The second stage riser regeneration zone may or may not be of a uniform diameter throughout the length thereof. It is shaped, however, in a restricted diameter section as a half circle adjacent the upper terminal end thereof to discharge a regenerated catalyst high temperature suspension downwardly through the top of a relatively large regenerated catalyst disengaging and accumulation zone. It is contemplated recycling some recovered second stage regenerated catalyst particles to the riser inlet thereof for admixture with the partially regenerated catalyst passed thereto from the first stage of regeneration. An oxygen containing gas of higher oxygen concentration than that used in the first stage of regeneration is charged to the second stage riser regeneration zone.

The regeneration gas used in the second stage is preferably an oxygen rich gas which rapidly achieve combustion of residual carbon on the partially regenerated catalyst and maintained at a temperature at least in the range of 1400° to 1600° F. The second stage of regeneration with oxygen rich regeneration gas is intended to produce $CO_2$ rich flue gases comprising some unconsumed oxygen less than a significant amount. The oxygen lean first stage of regeneration produces a flue gas comprising CO, $CO_2$ and substantial hydrogen. The amount of hydrogen produced will depend upon the reactions of steam and $CO_2$ with carbon and the promotional effect of nickel on the catalyst.

The separated and recovered high temperature regenerated catalyst of the second stage at a temperature in the range of 1400° F. up to 1600° F. obtained in the absence of steam is collected as a fluid bed of catalyst in a lower bottom portion of the separation zone preferably of limited inventory and maintained in down-flowing dense fluid phase condition. An inert gas such as $CO_2$ is charged to a bottom portion of thecollected bed of catalyst. In the event the regenerated catalyst is recovered at a temperature above that desired for use in one or both of the hydrocarbon conversion riser cracking zones, some indirect cooling of the catalyst may be accomplished or with the fluidizing gas charged, thereto. Indirect cooling of the regenerated catalyst may be had in the standpipes used to pass regenerated catalyst to each of the riser hydrocarbon zones herewith discussed. It is contemplated passing as required a portion of the collected regenerated catalyst of the second stage of regeneration to a bottom portion of the riser regeneration zone for admixture with the partially regenerated catalyst charged thereto.

Conversion of a hydrocarbon feed selected as herein provided is accomplished in a riser conversion zone which terminates in a semi-circular curved section which discharges downwardly from the downstream open discharge end thereof. The upper end of the riser is a half circle pipe section as shown in the drawing of limited diameter which discharges a centrifugally separated suspension downwardly through the open end thereof into a much larger catalyst-vaporous material separation and catalyst accumulation zone in open communication in the bottom thereof with the top of a catalyst stripping zone therebelow. The centrifugally separated catalyst particles pass downwardly from the riser discharge open end into a confined passageway of limited length and then countercurrent to stripping gas under elevated temperature stripping conditions preferably at least 1000° F. or higher.

The half circle discharge section of the riser conversion zone is a restricted diameter pipe section sized to particularly effect substantial centrifugal separation of a suspension comprising catalyst particles and vaporous hydrocarbon conversion product material passed therethrough prior to discharge of separated vapor-catalyst components downwardly from the open end of the riser. In this apparatus arrangement, the inlet to a plurality of cyclones arranged in a circle is external to but adjacent the inside of the half circle pipe section of the riser discharge and at the downstream discharge open end thereof. It is contemplated providing a baffle within and across the riser discharge end section which will operate to concentrate or house centrifugally separated catalyst particles on the outer side of the half circle section and away from separated vapors confined to the inside of the circular section. Thus, the suspension velocity entering the half circle of the riser discharge section should be sufficient to achieve the desired centrifugal separation of suspended solids from vapors but the velocity should not be so high that vapors are not separated from solids and are discharged downwardly into a lower section of the larger separation zone for recontact beyond the inlet to the cyclone separation zones. The cyclones are preferably maintained at a pressure below the pressure in the relatively large disengaging zone to encourage vapor to flow through the cyclones. A stream of centrifugally concentrated solids are projected downwardly and away from the vapor inlet to the cyclones. This trajectory of solids away from the cyclone inlet is implemented by downwardly extending the baffle means provided beyond the cyclone inlet so that the catalyst particles enter the upper open end of a cylindrical zone confining the discharged catalyst particles.

The centrifugal induced curved section of the riser hydrocarbon conversion zone adjacent the end thereof may be positioned within the disengaging zone or external thereto as shown in the drawing; or the apex of the circular half section may be positioned to pass through the vertical wall of the disengaging zone. On the other hand, the upper half circle section of the riser is preferably external to the vapor-catalyst disengaging zone with the discharge end thereof passing downwardly through the top head of the disengaging zone. The restricted diameter pipe curved section of the risers shown on the drawing centrifugally concentrates suspended catalyst particles from vapors for downward passage of catalyst solids in a central portion of the disengaging vessel and impact on a bed of catalyst particles collected in a stripping zone therebelow. Separation of entrained vapors from catalyst is accomplished with a stripping gas passing upwardly from the stripped catalyst bed into the disengaging zone. Thus, separation of hydrocarbon vapors and stripping gas from catalyst particles is facilitated substantially by the countercurrent contact between dispersed and dense phase catalyst particles and stripping gas prior to withdrawal of the stripping gas from the disengaging zone with separated product vapors of hydrocarbon conversion into the cyclone separation zones provided. A number of separate cyclone separation zones are placed around the downwardly discharged stream of catalyst particles adjacent the open end vapor side of the riser to form an annular ring of cyclones. This annular ring of cyclones may be attached to a second annular ring of secondary or second stage cyclone separation zones if desired but not shown on the drawing before withdrawing cyclone separated vapors as a common stream of vapors from a plenum or collecting chamber or other suitable vapor collecting manifold means positioned within or outside the disengaging zone.

The riser hydrocarbon conversion zones may be of uniform diameter throughout the length thereof, as shown by riser 26, or comprise an expanded section in an intermediate portion, thereof, such as shown in riser 14. In either of these riser arrangements, it is preferred that the oil feed to be converted be charged to a downstream section of the riser reactor and into a rising suspension of catalyst particles formed as herein provided in an upstream portion of the riser. That is, it is preferred to first form a rising suspension of catalyst particles in a fluidizing or lift gaseous material such as a gaseous product of cracking comprising hydrogen, an inert $CO_2$ flue gas product, steam, dry gas, wet gas, natural gas, propane, butane, other refinery available hydrogen rich gases, the lower alcohols of methanol, ethanol and propanol or other carbonhydrogen contributors suitable for the purpose. An atomized oil feed in diluent material is charged downstream in an expanded section of the riser for contact with the upflowing suspension of catalyst in hydrogen contributing fluidizing gases to obtain elevated temperature conversion to desired liquid fuel products. It is recognized in the prior art that the conversion of the hydrocarbon or residual oil feeds may be accomplished over a residence time in the range of a portion of a second up to several seconds and within the range of a fraction of a second up to 2, 3 or even 5 seconds. A hydrocarbon vapor residence time in contact with catalyst in a riser conversion zone is dependent upon the catalyst temperature, the feed to be converted, the catalyst to oil ratio employed and the level of conversion desired. A time in the range of about 0.5 to about 2 seconds is contemplated under elevated temperature cracking conditions providing a riser outlet temperature within the range of 900° to 1200° F. and more usually within the range of about 950° to 1050° F. or 1100° F. Thus, the temperature of the catalyst discharged from the separate riser conversion zones of this invention may be the same or of a different temperature and will be thereafter mixed upon downward flow through the stripping zone. It is preferred that the stripping zone temperature be maintained above about 900° F. and preferably at least 1000° F. or more. Thus, an elevated stripping temperature may be implemented by charging a hot $CO_2$ product of the catalyst regeneration operation to the stripper, adding hot regenerated catalyst to the spent catalyst and stripping the mixture in a separate stripping zone with steam and/or $CO_2$ at a temperature of at least 1200° F. or more. Stripping of the catalyst discharged from the riser conversion zones is accomplished in one particular embodiment with a hot $CO_2$ product of catalyst regeneration free of combustion supporting amounts of oxygen or with a hydrogen rich gas of water gas shift obtained from the first stage of regeneration of this invention. Thus, the stripping gas may be obtained from the flue gas of the first or second stage of regeneration or from a CO boiler zone not shown and used to generate process steam by combustion of CO rich gas recovered from a first stage oxygen lean gas catalyst regeneration herein discussed. Stripping of the catalyst may be accomplished with $CO_2$ alone and separately charged to two different levels of the stripping zone or steam may be used to strip the catalyst in a lower portion of the stripping zone with hot $CO_2$ being charged to an upper portion of the stripping zone. The catalyst thus stripped is then passed to the first stage of catalyst regeneration herein discussed for admixture with partially regenerated catalyst and lean oxygen containing regeneration gas comprising steam to form a mixture thereof sufficiently temperature elevated to initiate rapid conversion of the hydrocarbonaceous deposits of oil conversion on the catalyst particles.

The first stage of apparatus arrangement for catalyst regeneration may be as shown on the drawing for the first or second stage or the regenerator may comprise a riser coaxially aligned within the larger vessel and discharging into or above a catalyst bed being regenerated in an upflowing or a downflowing annular catalyst bed. In any of these arrangements, the combustion supporting gas of first stage regeneration is an oxygen lean gas less than air preferably comprising steam as herein discussed. The temperature of the first stage of regeneration is maintained at least 1300° F. and preferably at least about 1500° F. up to about 1600° F. during removal of hydrocarbonaceous deposits by combustion and water gas shift reactions preferably in excess of 50 wt. % and more usually at least 60 to 80 wt. % is removed in the first stage of catalyst regeneration.

The second stage of catalyst regeneration is preferably at a temperature equal to the first stage but under some high boiling reduced crude conversion operations the temperature may freely seek or be permitted to go above 1600° F. as required to obtain desired coke removal with oxygen rich gas. This second stage catalyst regeneration operation is preferably accomplished with oxygen rich gas and in the absence of steam to avoid hydrothermal damage of the catalyst particles.

In yet another embodiment, it is contemplated employing the apparatus of this invention to achieve a first stage of catalyst regeneration in an oxygen lean atmosphere without added steam to produce a flue gas rich in CO which is thereafter combusted in a downstream CO boiler to produce high pressure process steam for use in the process.

In still another embodiment, it is contemplated providing first and second stage riser regeneration zones arranged in side by side relationship and providing for relatively dense fluid catalyst phase upflow in each zone of at least 20 lbs/cu. ft. catalyst particle concentration in regeneration gases of the same or different temperature profiles. That is, the riser regenerators may be maintained at a temperature within the range of 1300° F. to 1600° F., and with the first stage of regeneration being below the second stage temperature. The first stage regeneration temperature may be restricted in one particular embodiment to be about 1400° F. and the second stage may be maintained preferably above about 1500° F. In any of these arrangements a primary objective is to remove a major portion of the carbonaceous deposits in the first stage of regeneration and complete the removal of residual coke in the second stage of regeneration.

BRIEF DESCRIPTION OF THE DRAWING

The drawing is a diagrammatic sketch in elevation of a combination operation comprising dual riser hydrocarbon conversion in side by side relationship in combination with adjacent sequential stages of catalyst regeneration. The separate stages of sequential catalyst regeneration permit the use of the same or different regeneration temperature conditions selected in response to the carbon deposition of the oil feeds being processed and the severity of hydrocarbon conversion practiced in each riser conversion zone.

DISCUSSION OF THE DRAWING

Referring now to the drawing, a selected residual portion of crude oil boiling above 400° F. is charged to the process by conduit 2 to a separation zone 4 wherein a rough separation is made to provide a light oil fraction recovered therefrom by conduit 6 and a heavier oil fraction recovered by conduit 8. The separated heavier oil fraction may be hydrogenated in zone 10 with hydrogen introduced by 9 to remove some sulfur, nitrogen and metal contaminants to provide a hydrogenated heavy oil fraction reduced in metal contaminants. On the other hand, the hydrogenation zone may be bypassed by conduit 11 when the heavier oil fraction is not to be hydrogenated. The hydrogenated heavier oil fraction is passed by conduit 12 to a first riser catalytic conversion zone 14. A dispersing and atomizing diluent material is charged by conduit 16 for admixture with and atomization of the heavier oil feed prior to entering the riser conversion zone 14.

In a particularly preferred embodiment, a regenerated catalyst comprising a hydrogen "Y" crystalline faujasite and comprising rare earths with less than 0.25 wt. % or not more than 0.1 wt. % residual coke thereon and at a temperature in the range of 1400° F. to 1600° F. is charged by conduit 18 for admixture with a fluidizing lift gas which preferably comprise a hydrogen containing gaseous product of cracking is charged by conduit 20 in a lower restricted diameter portion 22 of the riser reactor 14 to form a suspension thereof of desired particle concentration for flow upwardly therethrough. In the specific arrangement of the drawing, riser 14 is expanded to form a larger diameter section therein and the heavy oil feed with or without prehydrogenation is charged to the riser in the expanding transition section thereof, preferably in a highly atomized condition and at a velocity providing for rapid intimate contact between atomized oil droplets and finely divided suspended catalyst to effect rapid vaporization and catalytic conversion of the vaporized heavy oil droplets in the presence of hydrogen. It is further intended that the hydrocarbon vapor residence time in the riser reaction zone be restricted to less than about 3 seconds, preferably from 0.5 to about 2 seconds, before discharge of the catalyst suspension with vaporous product of hydrocarbon conversion and preferably the vapor residence time is not more than about 1.5 seconds.

The light oil feed in conduit 6 is also preferably mixed with an atomizing diluent material in conduit 24 and the atomized oil feed is then charged to a separate second riser conversion zone 26 of the same or different configuration than riser 14. The second riser conversion zone 26 comprises an initially formed upflowing suspension of regenerated catalyst particles in lift gas with or without hydrogen in a lower restricted diameter section of the riser. The catalyst is charged to the riser by conduit 28 and mixed with the lift gas with or without hydrogen or other suitable fluidizing lift gas such as steam charged by conduit 30 to form the upflowing suspension. The riser 26 is provided with an expanded transition section above the more restricted diameter suspension forming section. The light or selected lower boiling oil feed fraction admixed with atomizing diluent material such as a carbon-hydrogen fragment contributing material is atomized and then charged to the rising catalyst suspension preferably in the transition section of the riser. It is intended that the charged atomized light oil feed which is catalytically converted in the riser conversion zone be retained therein for a fraction of a second up to 1, 2 or more seconds. Under some conditions of selected feed composition, temperature and catalyst to oil ratio processing conditions the residence time of the vapors in the riser will be restricted to within the range of 0.5 to about 1.5 or 2 seconds before the vapor conversion product-catalyst suspension is discharged therefrom as herein provided. The hydrocarbon vapor residence time will depend in substantial measure upon the conversion temperature and the catalyst equilibrium acitvity as employed.

The suspensions of hydrocarbon vapors and catalyst particles passed upwardly through the separate riser conversion zones are discharged therefrom through half circle restricted diameter conduit sections 32 and 34 open in the downstream end thereof which directs centrifugally separated catalyst particles downwardly and substantially separately from vaporous material into a larger velocity reducing zone 36 comprising cyclone separating means. The half circle restricted diameter discharge section of each riser is sized to achieve substantial centrifugal separation of the catalyst particle solids from hydrocarbon conversion vapors comprising the suspension passed therethrough and prior to discharge thereof downwardly from the open end of each riser conversion zone. The centrifugal separation of solids from vapors is accomplished at a velocity in the range of 30 to 80 ft/sec. and the separation is sustained substantially by providing baffle means 38 and 40 across the discharge end of the riser adjacent the open end thereof and preferably above the upper open end of cylindrical zone 41, open in the bottom end thereof also. Cylindrical zone 41 maintains the centrifugally separated and concentrated catalyst solids from recontact with discharged vapors in the larger separation zone above the catalyst stripping zone 56. The solids separated from vapors pass downwardly through cylindrical member 41 for discharge from the bottom open end thereof into an upper end of a lower catalyst stripping zone.

In the arrangement of the drawing, the separate riser conversion zones pass upwardly external to a central stripping zone as shown, or they may pass through a conical bottom section 42 of the larger disengaging zone 36 for effecting suspension separation. The half circle discharge section of each riser is turned towards the other so that discharged centrifugally separated solids form a downwardly directed central stream of catalyst which pass through the cylindrical zone 41 as above discussed and impact upon the upper surface 44 of a mass of downflowing catalyst particles in the stripping zone therebelow. A plurality of cyclone separation zones comprising single stage or a plurality of sequentially arranged two stage cyclones in parallel represented by zones 46 and 48 are arranged as an annular combination of cyclone separation zones. The mouth of the first cyclone separation zone is shown positioned adjacent the vapor discharge or outlet side of the riser downward discharge in a location suitable for withdrawing concentrated vapors of desired and preselected velocity. The annular arrangement of cyclone separation zones may comprise a plurality of parallel two stage cyclones in open communication with a product withdrawal plenum chamber or external manifold 50. Vaporous products of hydrocarbon conversion are withdrawn from manifold 50 by conduit 52 for passage to a product fraction zone 54 to accomplished fractionation of hydrocarbon conversion products as more fully discussed below.

A mass of solid particles comprising catalyst particles with hydrocarbonaceous deposits of hydrocarbon conversion passed through cylindrical zone 41 is discharged from the bottom end thereof for flow downwardly as a fluidized mass of solid particles through a stripping zone 56 and counter current to stripping gas charged thereto by conduits 58 and 60. In this dual stripping gas inlet arrangement, steam or $CO_2$ alone or steam plus $CO_2$ stripping gas of desired elevated temperature is charged by conduit 58 to an upper part of the stripping zone. Steam with or without $CO_2$ is charged by conduit 60 to a lower portion of the stripping zone. The stripping gas comprising stripped hydrocarbon vapors pass from the upper surface 44 of the fluid bed of catalyst particle solids for passage upwardly through the disengaging zone and generally external to cylindrical zone 41 for eventual withdrawal by cyclones 46 and 48 provided. Thus, the discharged downwardly flowing confined stream of catalyst particles in the disengaging zone pass counter current to rising stripping gases emanating from the catalyst bed in the stripping zones following discharge from the bottom open end of cylindrical zone 41 positioned above the upper surface level 44 of the collected catalyst particles. Catalyst particles are withdrawn from the bottom of stripping zone 56 by conduit 62 for passage to a bottom portion or lower locus of the restricted diameter regeneration gas-catalyst mixing riser regeneration zone 64 to initiate regeneration thereof as herein after provided.

An important aspect of the multi-stage regeneration operation of the invention is concerned with maintaining a desired heat balance in the combination operation without exceeding undesired elevated temperature and hydrothermal damage to the catalyst particles. The objectives of the combination operation of this invention are achieved in substantial measure by employing a low coke producing catalyst in the hydrocarbon conversion operations above described and thereafter removing hydrocarbonaceous deposits in a sequence of catalyst regeneration operations maintained under selected operating conditions discussed herein.

In the specific arrangement of the drawing, the spent catalyst particles recovered from stripping zone 56 and comprising hydrocarbonaceous deposits are initially contacted in a first riser contact zone 64 with preferably an oxygen lean combustion supporting gas 65 comprising steam added by conduit 66. Recycled partially regenerated catalyst particles at an elevated temperature of at least 1400° F. and obtained as herein after discussed is added by conduit 68 for admixture with the cooler spent catalyst particles charged by conduit 62. The partially regenerated catalyst particles at a temperature in the range of 1400° to 1600° F. in combination with a preheated oxygen containing gas comprising steam at a temperature of at least 1000° F. provides the heat input which is sufficient to initiate removal of hydrocarbonaceous deposits by oxygen combustion of carbonaceous material and/or effect partial water gas shift reaction to produce a flue gas product comprising carbon oxides and sulfur oxides with or without hydrogen. Thus, it is contemplated partially regenerating the catalyst with an oxygen lean regeneration gas of low or high steam to oxygen ratio. It is preferred to employ a steam to oxygen ratio in the range of 1 to 4 to achieve partial regeneration of the catalyst and produce flue gas comprising CO and $CO_2$ with or without hydrogen.

The first stage of catalyst regeneration is preferably accomplished as an upflowing suspension of dispersed and/or dense catalyst phase upflowing in a regeneration zone at a particle concentration in the range of 10 to 35 lbs/cu. ft. The riser regeneration zone 72 may be a constant relatively larger diameter zone above mixing section 64 or it may comprise more than one expanded section as shown in the drawing. In any of these apparatus arrangements it is contemplated removing from 30 to 80 wt. % of the deposited hydrocarbonaceous material in this first stage of regeneration maintained at a temperature in the range of 1400° to 1600° F. The partially regenerated catalyst particles and flue gas product pass from the upper end of the expanded regeneration zone through a confined generally horizontal or curved passageway 74 discharging horizontally and tangentially into a flue gas-catalyst particle separation and collection zone 76. Separated flue gases pass upwardly through a centrally located passageway 80 communicating with a plurality of radiating passageways to cyclone separation zones 82 positioned preferably external to zone 76. Cyclone separated catalyst particles are returned to zone 76 by diplegs provided. The regeneration flue gases are recovered from the cyclones by conduit 84. The separated partially regenerated catalyst is collected as a fluid relatively dense mass of particles in a bottom portion of zone 76 for withdrawal therefrom by conduit 86. The partially regenerated catalyst is passed to a bottom section of a second separate stage of catalyst regeneration by conduit 86. A portion of the partially regenerated catalyst withdrawn by conduit 86 is passed by conduit 68 to the lower locus or catalyst mixing zone of the first stage of regeneration discussed above.

The second stage of catalyst regeneration is effected in a riser regeneration zone of apparatus means similar in configuration to that shown or similar to that used for the first stage of regeneration discussed above. The second stage of catalyst regeneration is effected in a riser regenerator zone 88 comprising an expanded diameter section to which a lower more restricted diameter catalyst mixing section 90 is provided. The partially regenerated catalyst in conduit 86 is charged to a lower portion of section 90 for admixture with more completely regenerated catalyst particles charged thereto by conduit 92 along with an oxygen rich regeneration gas charged by conduit 94 to form an upflowing suspension thereof. The charged oxygen rich gas is preferably preheated to a temperature in the range of 500° to 1000° F. to encourage rapid ignition of residual carbon (carbonaceous) deposits on the partially regenerated catalyst during passage of a formed suspension upwardly through the riser regenerator 88. It is contemplated employing a suspension in the second stage of regeneration comprising a catalyst particle concentration in combustion supporting gases in the range of 5 to 35 lbs/cu. ft. and more usually within the range of 10 to 30 lbs/cu. ft. Some additional oxygen containing gas may be added to the expanded portion of the riser regenerator by conduit 94 to maintain desired upflowing suspension velocity conditions and sufficient oxygen to complete combustion of residual carbon on catalyst particles.

The upper discharge end of riser 88 comprises a half circle passageway 96 or pipe section of restricted diameter dimension and half circle diameter dimensions contributing to a suspension velocity increase providing substantial centrifugal separation of hot regenerated catalyst particles from combustion product flue gases prior to downward discharge from the open end thereof. The flue gases rich in ($CO_2$) carbon dioxide with or without some unconsumed oxygen depending on the severity of the regeneration operation reduce the residue carbon to at least 0.25 wt. % and more usually to at least 0.10 wt. % or lower. An important aspect of the second stage of regeneration when obtaining particles of catalyst at a temperature above 1400° F. or 1500° F. and above is in obtaining a separation between hot flue gases and catalyst particles in less expensive refractory lined vessels of carbon steel and comprising little, if any, metal exposed appendages dependent upon the use of expensive heat resistant alloys. This is accomplished in the apparatus arrangement of this invention by discharging a hot flue gas-catalyst particle suspension downwardly from the riser regenerator through the top of a separation and catalyst particle collection vessel 98. The discharge end of the riser is extended a sufficient distance downward by collar means 100 of the same diameter or larger diameter than the riser outlet to provide an annular space 101 thereabout in a top portion of vessel 98 from which separated flue gases are withdrawn. Radiating passageways 102 extend outwardly from said annular section 101 in open communication with preferably externally positioned cyclone separation means 104. The velocity and trajectory of discharged regenerated catalyst particles encourages the separation from flue gases. Catalyst particles entrained in flue gases are separated in the external cyclones 104 with the separated catalyst fines returned to vessel 98 by diplegs provided for deposit in collected catalyst bed 106. Flue gases comprising substantial $CO_2$ are removed from the cyclones by conduits 108. The separated catalyst is collected as bed 106 in a bottom portion of vessel 98. The catalyst regeneration apparatus of this invention comprising two separate sequentially arranged catalyst flow regeneration zones may be of the same configuration of either the first or second regeneration means as above recited. When it is contemplated using the first stage apparatus in the second stage and achieving regeneration temperatures above about 1500° F. or above 1600° F. the apparatus is preferably modified to include a downwardly extended collar of larger diameter than conduit 80 and discharging the regenerator suspension tangentially within the collar. The regeneration vessels provided with external cyclone separation means and interconnecting conduits may all be refractory lined thereby permitting fabrication of vessel. from the less expensive metals suitable for the purpose, such as carbon steel.

The regenerated catalyst particles collected in zone 98 as catalyst mass 106 is preferably of a relatively low inventory of catalyst particles maintained in fluid like condition by the addition of a suitable fluffing gas by inlet means 107. The catalyst collected in zone 106 at an elevated temperature above 1400° F. up to 1600° F. or more, is withdrawn from the bottom thereof for distribution as provided below. Some is passed by conduit 92 to a bottom portion of riser regenerator 88, some is passed by conduit 28 for passage to a bottom portion of riser 26 and some is passed by conduit 18 for passage to a bottom portion of riser section 22 of riser 14. In the event that the temperature of the regenerated catalyst 106 needs to be adjusted downwardly for use in the riser hydrocarbon conversion operations, it is preferred that this adjustment occur directly or indirectly in zones not shown located in transfer conduits 18 and 28. Such temperature adjustment may be accomplished in catalyst coolers in indirect heat exchange with boiler feed water or other suitable heat exchange fluids such as the oil feed atomizing diluent material or gaseous material used to fluidize the catalyst and charged to one or more of the riser conversion zones. On the other hand, the stripping gas used in stripper 56 and charged by either conduits 58 and 60 may be heated indirectly in catalyst cooling means in either one or both of transfer conduits 18 and 28.

The vaporous products of hydrocarbon conversion recovered from cyclones 46 and 48 by conduit 5 for transfer to fractionation zone 54 are separated therein substantially as follows. A wet gaseous product comprising hydrogen is recovered by conduit 110, a $C_5$ plus gasoline product is recovered by conduit 112, a light cycle oil product is recovered by conduit 114 and a heavy cycle oil product is recovered by conduit 116. When it is desired to maximize gasoline products, a portion of the light cycle oil may be recycled by conduit 120 for admixture with the oil fraction in conduit 6. The heavy cycle oil may also be recycled by conduit 122 for admixture with oil feed in conduit 11 or it may be charged to the hydrogenation zone 10 by a by-pass conduit as shown. When it is desired to increase the yield of light hydrocarbons boiling above gasoline to increase the yield of jet engine and diesel fuels it is preferred to recycle hydrogenated heavy cycle oil with or without light cycle oil to riser 14 and reduce the severity of catalytic cracking accomplished in the riser cracking zone 26 and 14. Also, a less active crystalline zeolite catalyst may be provided in the system to achieve this end.

It will be recognized by those skilled in the catalytic cracking art that the combination operation of this invention is adaptable to many different feed compositions, catalyst compositions and operating process variations without departing substantially from the spirit and scope of this invention. It will also be realized by those having considerable knowledge of the prior art that the discussed regeneration techniques of this invention encompassed to some extent that disclosed in U.S. Pat No. 2,702,267, issued 2/15/55. This reference discussed some basic known reactions in which catalyst comprising coke deposits may be partially regenerated by removing coke with a mixture of steam and high purity oxygen at a regeneration temperature above 1400° F. and preferably up to about 1600° F. Thus, carbonaceous deposits (coke) are eliminated from a cracking catalyst with steam in combination with oxygen to some considerable extent and product gases comprising hydrogen, carbon oxides and excess steam may be recovered. The principal and known reactions are:

(A) $2C+O_2=2CO$
(B) $C+O=CO$
(C) $C+CO_2=2CO$
(D) $C+H_2O=CO+H_2$
(E) $CO+H_2O=CO_2+H_2$

Reactions A, B and E are exothermic while C and D are endothermic. Achieving a proper balance between these reactions to achieve partial regeneration of the catalyst is part of this invention.

The above prior art is supplemented in part by a paper entitled "Reactions Of Steam With Coke On Solid Substrates" by T. Y. Yan et al, presented before the Division of Petroleum Chemistry, Inc., Washington Meeting, Sept. 9–14, 1979. This paper addresses the subject of reaction of steam with coke deposits without oxygen on silica alumina at temperatures in the range of 1400° F. to 1600° F. and the influence of Ni, V, Fe and Cu on the reaction at 1500° F. Nickel accelerated the initial gasification rate but the other metals had no significant effect; it being speculated that they formed a complex with the silica alumina catalyst. This method of collecting the other metal contaminants of V, Fe Cu and other methods discussed in the prior art is particularly desired when processing residual portions of crude oil comprising substantial metal contaminants.

The regeneration operating conditions of this invention may be modified to exclude or include, to some considerable extent, the above prior art reaction mechanism. It is preferred to achieve oxygen combustion exothermic reactions sufficient to support the endothermic reactions above identified, when exposing the catalyst to high temperature steam only when the catalyst comprises substantial carbonaceous deposits such as in the first stage of regeneration in order to minimize hydrothermal damage to the catalyst. Thus, the second stage of catalyst regeneration is accomplished in the absence of steam with oxygen rich gas such as air or an oxygen enriched gas to achieve high temperature combustion removal of residual coke without exposing the catalyst to hydrothermal damage.

In an embodiment of this invention above identified, it is contemplated subjecting a heavy high boiling portion of crude oil such as a vacuum resid to solvent extraction to reject asphaltenes and resins with a known solvent such as propane, butane, pentane or hexane and combinations thereof. On the other hand, a solvent extraction-deasphalting process providing a deep solvent deasphalting (DSDA) operation with butane, pentane and hexane may be employed to increase the yield of oil components suitable for catalytic cracking. In yet another aspect, when deasphalting a long boiling range feed mixture, it is contemplated employing a mixture of propane and butane under liquid phase extraction conditions. Thus, an atmospheric tower bottoms fraction of crude oil and comprising an initial boiling point in the range of 700° to 800° F. or that portion of the crude comprising heavy vacuum gas oil may be charged as the feed to the solvent deasphalting operation to increase the yield of contaminant metals removal. Thus, the choice of the feed to the deasphalting operation will depend upon the source of the crude oil to be upgraded by the combination operation of this invention.

In a particular aspect, it is contemplated providing and using a solvent deasphalting operation at a severity accomplishing recovery of an oil extract phase by volume of residuum in the range of about 80 to 95% and an asphalt phase or solvent reject phase within the range of 5 to 20% asphalt components by volume of residuum. When pursuing a deep solvent deasphalting operation of vacuum resid, it is preferred to use a hydrocarbon solvent of a molecular weight in the range of 50 to 85 and in an amount which will precipitate from 5 to about 10 volume percent or more of the asphalt components of the residuum.

It is further contemplated cracking an oil product of delayed coking of reduced metals, sulfur and nitrogen content or a liquid product of coal solvation comprising naphthalene ($C_{10}H_8$) and its isomers particularly after effecting a relatively mild or severe hydrogenation treatment sufficient to achieve some hydrocracking thereof accompanied by hydrogenation.

Effecting a hydrogenation treatment of the heavy oil feed components as above discussed effects a partial removal of entrained metal contaminants of Ni, V, Fe and Cu in the high boiling feed components. This hydrogenation treatment accompanied by the deasphalting operation also reduces the feed Conradson carbon contributing components to at least 5, and more usually in the range of 2 to 4. The obtained reduction in metal contaminants carried with the feed to the heavy oil riser cracking step reduces the rate of contaminants metals accumulation on the catalyst thereby contributing to a lower catalyst replacement rate and the accumulated metals may be passivated by techniques known in the art by a lower rate of passivating agent addition contributing substantially to the economics of the process.

The combination of apparatus identified and described above is preferably sized to provide a relatively low profile system of relatively low velocity and circulated catalyst inventory per barrel of feed charged.

Having thus generally and specifically described the combination of apparatus provided and the method of use thereof comprising this invention, it is to be understood that minor variations may be made thereto without departing from the scope except as defined by the claims below.

It is claimed:

1. In a process for converting residual portions of crude oils boiling above 400° F. wherein a low boiling fraction is catalytically cracked in a first riser cracking zone with a suspended zeolite containing catalyst and a higher boiling fraction is catalytically cracked in a second separate riser cracking zone with a suspended zeolite containing catalyst, the zeolite catalyst used in each of said separate first and second cracking zones being collected, co-mingled, stripped and regenerated, the improvement which comprises, (a) forming an upflowing suspension of a regenerated zeolite cracking catalyst at an elevated cracking temperature in a lift gas comprising hydrogen in the lower portion of each of two separate riser cracking zones, (b) charging an atomized low boiling oil feed in diluent gasiform material in contact with said upflowing catalyst suspension in a first riser zone for vaporized hydrocarbon contact residence time within the range of 0.5 to 3 seconds, (c) charging a higher boiling atomized oil feed in gasiform diluent material in contact with said upflowing catalyst suspension in a second separate riser zone for a vaporized hydrocarbon contact time with said catalyst within the range of 0.5 to 3 seconds, (d) discharging centrifugally separated suspensions of catalyst particles and vapors downwardly from each of said riser zones into a larger vapor velocity reducing zone comprising an open end cylindrical zone through which discharged catalyst particles are passed, (e) passing separated velocity reduced hydrocarbon vapors into a plurality of parallel arranged cyclone separation zones located adjacent the locus of discharge of centrifugally separated vapors from said riser zones, (f) stripping separated catalyst discharged from the riser zones in a common stripping zone at an elevated temperature, located beneath said open end cylindrical zone, (g) regenerating the stripped catalyst in a sequence of separate catalyst regeneration zones at a temperature above 1300° F. employing steam in admixture with an oxygen lean regenerating gas and partially regenerated catalyst in a first upflowing catalyst riser regeneration zone to achieve removal of a major portion of deposited hydrocarbonaceous material of hydrocarbon conversion, (h) further regenerating the partially regenerated catalyst with oxygen rich gas in the absence of steam in an upflowing catalyst second regeneration zone of elevated temperature discharging into a larger velocity reducing and regenerated catalyst collection zone, (j) maintaining collected and regenerated high temperature catalyst as a fluid mass of particles by passing an inert lift gas upwardly therethrough, (k) recovering $CO_2$ rich flue gases comprising unconsumed oxygen from an upper part of the second regenerated catalyst collection zone, said $CO_2$ rich flue gases separated from catalyst passed through a plurality of cyclone separation zones arranged external to the collection zone, (l) passing regenerated catalyst from the collected fluid mass of particles in said collection zone to each of said first and second riser hydrocarbon conversion zones, and (m) recovering hydrocarbon products of said separate riser zones for separation in a common product fractionation zone.

2. The process of claim 1 wherein said low boiling oil feed has an end boiling point below vacuum gas oils.

3. The process of claim 1 wherein said low boiling oil feed has an end boiling point of about 800° F.

4. The process of claim 1 wherein said higher boiling oil feed comprises vacuum gas oils with or without vacuum resid.

5. The process of claim 1 wherein the higher boiling oil feed is subjected to hydrogenation to remove sulfur, nitrogen and metal contaminants prior to said oil feed being charged to said riser cracking zone with atomizing diluent material.

6. The process of claim 1 wherein a heavy cycle oil product of the riser cracking zones is recycled with the higher boiling oil feed portion either before or after partial hydrogenation thereof.

7. The process of claim 1 wherein a slurry oil product of said higher boiling oil cracking operation is recovered and charged with said higher boiling oil feed.

8. The process of claim 1 wherein the cylindrical zone is positioned intermediate the open discharge end of the riser reactors and the stripping zone therebelow to minimize recontact between centrifugally separated hydrocarbon vapors and catalyst particles following discharge from said separate riser conversion zones.

9. The process of claim 8 wherein said discharged stream of catalyst particles from said risers pass counter current to stripping gas emanating from the upper surface of the mass of collected catalyst particles and flow to said plurality of cyclone separation zones for withdrawal.

10. The process of claim 1 wherein said catalyst separated from hydrocarbon product vapors is stripped at a temperature above 1000° F. with a stripping gas selected from $CO_2$ and steam.

11. The process of claim 1 wherein separated catalyst discharged from said risers is stripped of hydrocarbon vapors initially with charged $CO_2$ at a temperature above 1000° F. and then with charged steam.

12. The process of claim 1 wherein the catalyst comprising carbonaceous deposits and metal contaminants is regenerated with an oxygen lean gas comprising steam at a temperature in the range of 1400° to 1600° F. to produce a flue gas thereof comprising $CO_2$, CO and hydrogen.

13. The process of claim 12 wherein the partially regenerated catalyst is contacted at an elevated temperature with oxygen rich gas in the absence of steam in a separate second riser regeneration zone discharging into the top portion of a catalyst separation and collection zone free of internal cyclone separation zones and a $CO_2$ rich flue gas is separately recovered from regenerated catalyst particles at a temperature above 1400° F.

14. The process of claim 13 wherein the catalyst regenerated in said second riser regeneration zone discharges downwardly into the top of said separation and collection zone following centrifugal separation from flue gases and separated flue gases pass to cyclone separation zones external to and about the upper end of said separation and collection zone.

15. The process of claim 12 wherein a rising suspension of catalyst particles in flue gas product in said first regeneration zone is discharged horizontally and tangentially within an upper part of a suspension separation and catalyst particle collection zone and flue gases separated from tangentially introduced catalyst particles pass upwardly through a passageway communicating with a plurality of radiating passageways to cyclone separation zones on the outer end of each radiating passageway.

16. The process of claim 14 wherein the separated and collected high temperature catalyst of said second regeneration zone is collected in a zone of conical bottom to which is charged a stripping and fluffing gas through a lower wall portion of the conical bottom above the locus of regenerated catalyst withdrawal therefrom for passage to each of said second riser regeneration zone and said riser hydrocarbon conversion zones.

17. The process of claim 1 wherein a light cycle oil product and a heavy cycle oil product is separated and recovered from said common fractionation zone, said heavy cycle oil product is recycled to said riser zone effecting catalytic conversion of said higher boiling oil feed either with or without prehydrogenation and said light cycle oil is recycled to said riser effecting catalytic cracking of said low boiling oil feed when it is desired to increase the yield of gasoline boiling range product.

18. A combination process for cracking low and higher boiling fractions of crude oils with an ultrastable crystalline "Y" faujasite zeolite catalyst comprising rare earths and regenerating the catalyst which comprises, (a) forming an upflowing suspension of said catalyst in gaseous material comprising hydrogen in each of two first and second separate riser hydrocarbon conversion zones, (b) charging a low boiling fraction of crude oil with diluent material to a first riser conversion zone for contact with the formed rising catalyst suspension therein under conversion conditions maintained to provide a vaporous product of a temperature in the range of 900° to 1050° F. in a time frame less than 2 seconds, (c) charging a higher boiling fraction of crude oil following hydrogenation thereof and mixed with a diluent material to the second riser conversion zone for contact with said rising catalyst suspension therein under conversion conditions maintained to provide a vaporous product of a temperature up to about 1100° F. in a time frame less than about 3 seconds, (d) said catalyst-vapor suspensions in said first and second riser conversion zones each passing through restricted semi-circular passageways which provides centrifugal separation of vapors from catalyst particles prior to discharging the separated suspensions downwardly into a central portion of a large disengaging zone in open communication with a lower catalyst stripping zone, (e) passing the catalyst particles discharged from said risers downwardly through a confined open end passageway and out of contact with discharged vapors of hydrocarbon conversion into the upper end of said stripping zone, (f) withdrawing centrifugally separated vapors discharged from said riser through a plurality of cyclone separation zones arranged in a ring about discharge open ends of the risers, (g) stripping catalyst in said stripping zone and passing the stripping gas upwardly through the disengaging zone for withdrawal by said plurality of cyclone separation zones, (h) regenerating the stripped catalyst in a sequence of riser regeneration zones at a temperature of at least 1400° F. with oxygen lean gas and steam in the first riser regeneration zone under conditions to obtain reactions of water gas shift and partial combustion and thereafter further regenerating the catalyst in a second riser regeneration zone with an oxygen rich gas in the absence of steam, to provide regenerated catalyst particles of a temperature of at least 1500° F., and (i) discharging the suspension of catalyst and flue gas product of either the first and second riser regeneration zones horizontally and tangentially into the upper end of a catalyst separation zone to obtain centrifugal separation of catalyst particles therein from flue gases, (j) passing separated flue gases by radiating passageways to cyclone separation zones externally about the upper end of said separation zone, (k) collecting separated regenerated catalyst particles in a bottom portion of said separation zone for sequential cascade from said first regeneration zone to the second regeneration zone and thence to said riser hydrocarbon conversion zones.

19. The process of claim 18 wherein regenerated catalyst recovered from each riser regeneration zone is recycled in part to the regeneration zone from which said catalyst is recovered to provide heat to the suspension formed in each regeneration zone.

20. A method for upgrading a residual portion of a crude oil to form gasoline and light cycle oil which comprises, (a) separating a residual portion of crude oil into a relatively low boiling fraction comprising atmospheric gas oil from a higher boiling fraction of said residual oil, (b) solvent deasphalting at least the resid portion of vacuum distillation of said higher boiling fraction and recovering a deasphalted oil product from a deasphalting solvent selected from propane, butane, pentane, hexane and combinations thereof, (c) partially hydrogenating said deasphalted oil product in the presence of a heavy vacuum gas oil fraction boiling intermediate said light vacuum gas oil and said vacuum resid, (d) passing said partially hydrogenated oil product mixed with an atomizing diluent material in contact with an upwardly flowing low coke producing crystalline zeolite containing catalyst suspended in a gas comprising hydrogen in a first riser heavy oil feed hydrocarbon conversion zone, (e) passing said separated low boiling fraction of crude oil with light vacuum gas oil in contact with a separate rising suspension of said elevated temperature low coke producing crystalline zeolite containing catalyst suspended in a gas comprising hydrogen in a second riser hydrocarbon conversion zone, (f) effecting a partial centrifugal separation between hydrocarbon conversion product vapors and catalyst particles in a semi-circular section of each of said first and second riser conversion zones before effecting discharge thereof downwardly into the upper portion of a large separation and catalyst collection zone in open communication in the bottom thereof with a lower catalyst stripping zone, (g) withdrawing discharged separated vapors into cyclone separation zones radially displaced outside the lower locus of each riser downward discharge opening, (h) passing downwardly discharged separated catalyst through said stripping zone counter current to stripping gas thereafter recovered by said cyclones, (i) recovering hydrocarbon conversion products of said riser conversion zones from said cyclone separation zones, (j) passing the stripped catalyst through a sequence of separate riser regeneration zones maintained at a temperature above 1300° F. wherein the presence of steam in the first regeneration zone is sufficient to achieve a limiting combustion temperature level and the combustion of residual carbon on partially regenerated catalyst is accomplished in a second riser regeneration zone with oxygen containing gas in the absence of steam at a temperature above the temperature in the first riser regeneration zone, and (k) passing regenerated catalyst at a temperature between 1400° and 1600° F. to each of said first and second riser hydrocarbon conversion zones.

* * * * *